United States Patent [19]

Wallis

[11] 4,032,018

[45] June 28, 1977

[54] WORKPIECE TRANSFER MECHANISM

[76] Inventor: Bernard J. Wallis, 25200 Trowbridge Ave., Dearborn, Mich. 48124

[22] Filed: Nov. 21, 1975

[21] Appl. No.: 634,122

[52] U.S. Cl. ..... 214/1 BB; 100/144; 198/750

[51] Int. Cl.[2] ..... B65G 47/90

[58] Field of Search ..... 214/1 BB; 198/218, 486, 198/750; 100/144

[56] References Cited

UNITED STATES PATENTS

| | | | |
|---|---|---|---|
| 3,135,395 | 6/1964 | Wallis | 214/1 BB |
| 3,155,241 | 11/1964 | Suofy | 214/1 BB |
| 3,411,636 | 11/1968 | Wallis | 214/1 BB |
| 3,421,637 | 1/1969 | Sofy | 214/1 BB |
| 3,620,381 | 11/1971 | McCaughey | 214/1 BB |
| 3,738,503 | 12/1973 | Wallis | 214/1 BB |

*Primary Examiner*—Frank E. Werner
*Attorney, Agent, or Firm*—Barnes, Kisselle, Raisch & Choate

[57] ABSTRACT

A workpiece transfer mechanism for indexing workpieces through successive stations of a die in a stamping press wherein workpiece gripping finger bars are actuated by a cam mounted on the press ram to reciprocate therewith.

13 Claims, 9 Drawing Figures

WORKPIECE TRANSFER MECHANISM

This invention relates to a transfer mechanism for stamping presses, and more specifically, to a device for progressively indexing workpieces through the successive stations of a multi-station die mounted in the press.

Transfer mechanisms of the general type to which the present invention relates have been used with multi-station dies in stamping presses for many years. Such mechanisms frequently employ a carriage shiftable in a linear path through a stroke corresponding to the distance between successive stations in the die and a work engaging finger bar mounted on the carriage to move therewith and shiftable in a direction transversely of the path of travel of the carriage between work engaging and retracted positions. Normally a single power source is employed to drive both the carriage and the finger bar through means which usually include numerous gears. A long gear train employed for driving both the carriage and the finger bar is undesirable in many instances, particularly in presses operating at relatively high speeds. The inertia of the carriage coupled with the accumulated backlash in the long gear train produces an undesirable erratic motion of the finger bar resulting in overtravel and relatively high impact forces between the finger bar and the workpieces.

The primary object of the present invention resides in the provision of the transfer mechanism designed to operate smoothly at high speeds with a minimum of backlash and overtravel of the finger bar.

A futher object of the invention is to simplify the adjustment of the timing relationship between the carriage and the finger bar movements in relation to the stroke of the press ram.

The present invention achieves the foregoing objects by employing entirely separate drives for the carriage and the finger bar, the drive for the finger bar comprising a mechanism operated strictly by the motion of the ram of the press. The finger bar drive includes a cam fixedly, but adjustably, mounted on the press ram to move vertically therewith and a cam follower mounted on a stationary part of the transfer mechanism in the path of travel of the cam. The cam follower is engaged with a track on the cam and is adapted to be displaced in response to reciprocation of the press ram. The cam follower is in turn operatively connected to the finge bar such that on the downstroke of the ram the finger bar is retracted and on the upstroke of the ram the finger bar is shifted to the work engaging position. By adjusting the cam vertically on the press ram the timing of the finger bar operation can be varied in relation to the position of the ram. The separate drive mechanism for the carriage is also synchronized with the motion of the ram to advance the workpieces after they are engaged by the finger bar and to return to its starting position where the finger bar releases the workpieces.

Figure 1:
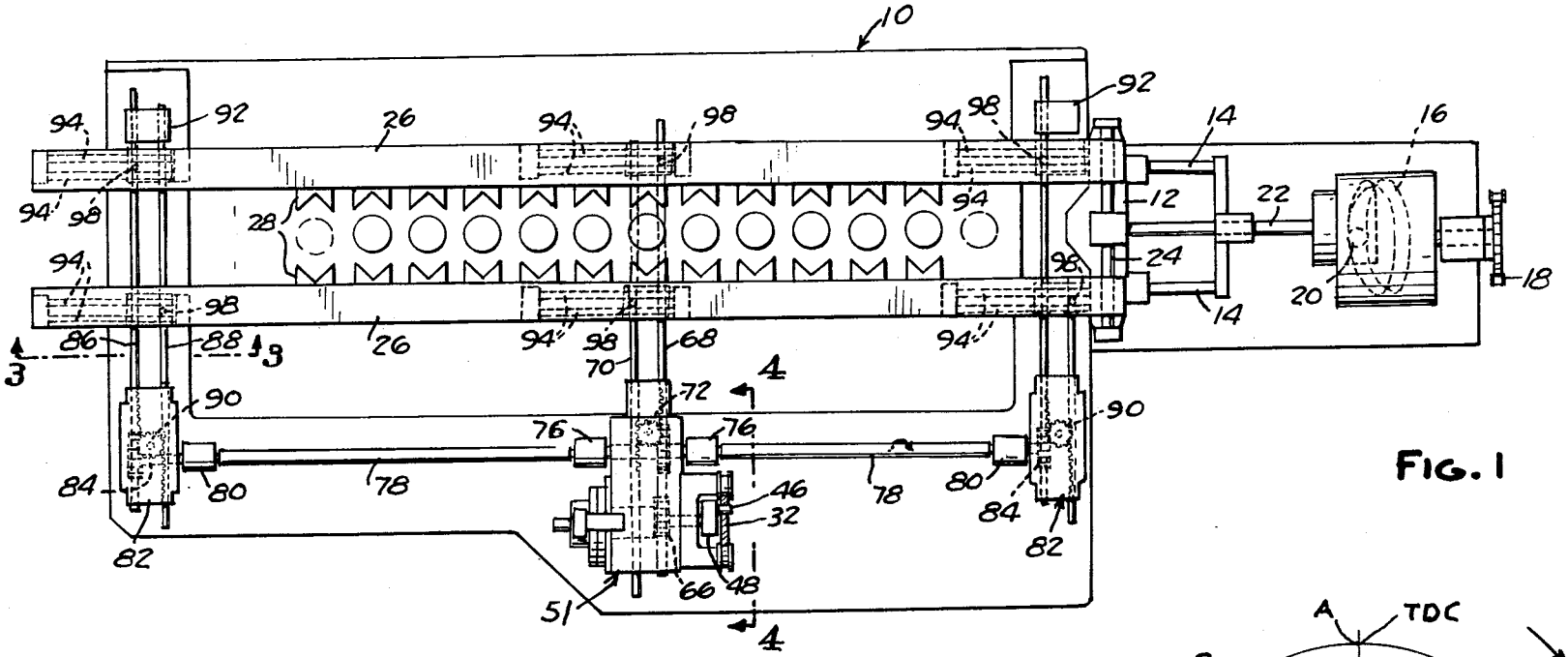
FIG. 1 is a plan view of a transfer mechanism embodying the present invention.

In the arrangement shown in FIG. 1 the transfer mechanism includes a base plate 10 on which a carriage in the form of a crosshead 12 is mounted for a longitudinal movement on a pair of guide rods 14. The drive for reciprocating carriage 12 includes a barrel cam 16 rotated by chain drive 18 from a suitable power source, such as the crankshaft of the press. A cam follower 20 engaged with the track cam 16 is fixed to one end of a connecting rod 22. The other end of rod 22 is connected to carriage 12. With this arrangement, when cam 16 rotates, carriage 12 is reciprocated longitudinally through its stroke on guide rods 14.

Carriage 12 includes a transversely extending guide rod 24 on one end of which a pair of finger bars 26 are slidably mounted for reciprocation toward and away from each other. Finger bars 26 have a plurality of work gripping fingers 28 mounted on and spaced apart lengthwise thereof a distance corresponding to the spacing of workpieces 30 in the successive stations of a multi-station die (not illustrated) mounted on the bolster of the press. The arrangement thus far described is more or less conventional. In such an arrangement a drive mechanism is employed which is timed in relationship to the vertical movement of the press ram such that when the ram is traveling upwardly the finger bars 26 are shifted toward each other to grip the workpieces 30 and carriage 12 is thereafter shifted to the left as viewed in FIG. 1 to advance the workpieces to the next successive station in the die. Normally the step of advancing the workpieces occurs while the press ram is traveling through top dead center. On the downstroke of the press ram the finger bars are retracted to a position clearing the punches on the ram and while the punches are forming the workpieces the carriage 12 is retracted to its starting position.

Figures 4, 5:
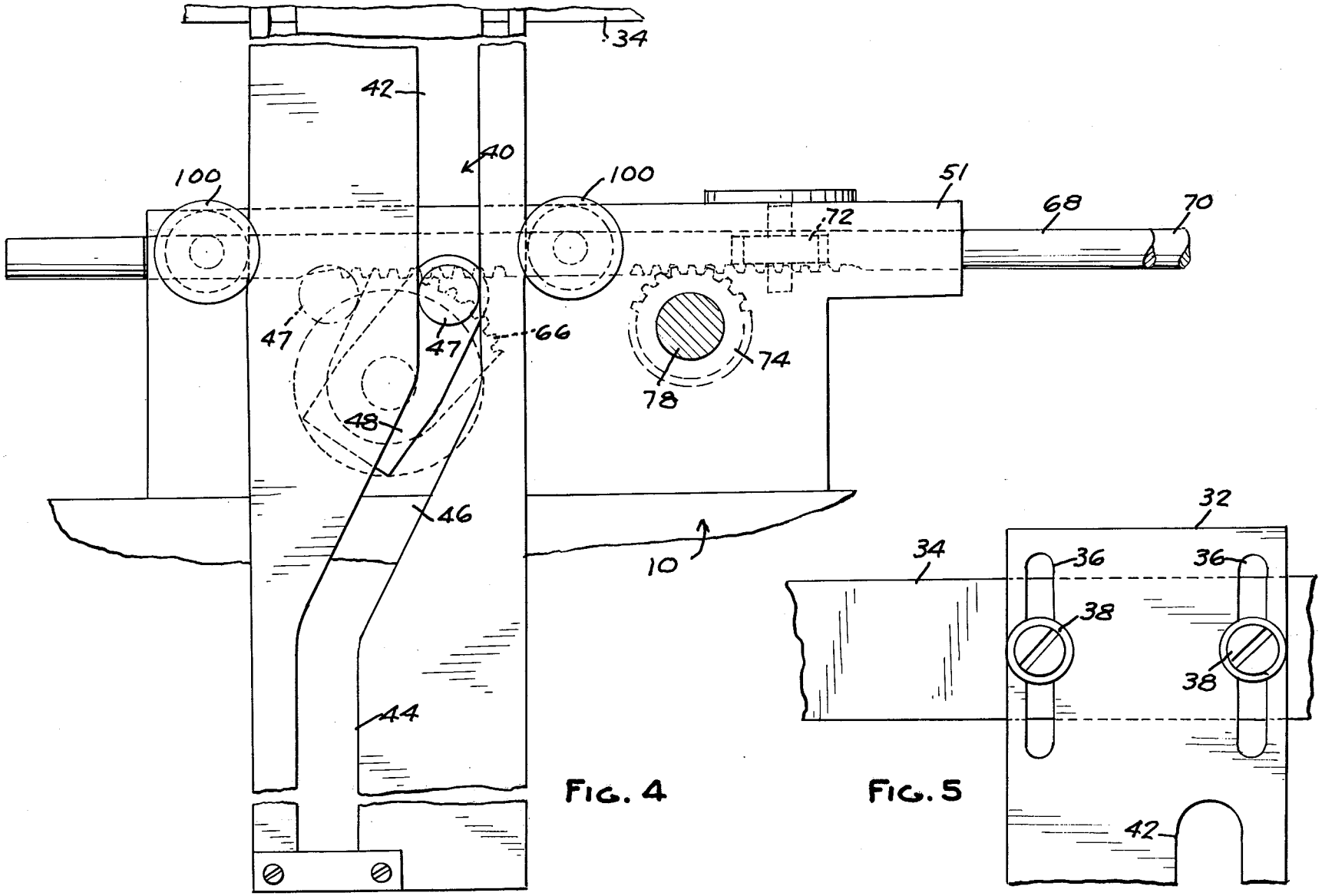
FIG. 4 is a sectional view on an enlarged scale along the line 4—4 in FIG. 1.
FIG. 5 is a fragmentary view of the upper end of the cam plate shown in FIG. 4.

The present invention is concerned primarily with the mechanism for reciprocating the finger bars 26 toward and away from each other. As shown in FIGS. 4 and 5, this mechanism includes a cam plate 32 mounted in a vertically depending position on the press ram 34. The upper end of cam plate 32 has a pair of vertically extending slots 36 through which clamping screws 38 extend for securing cam plate 32 on ram 34 in a vertically adjustable position. Cam plate 32 is formed with a generally vertically extending cam track 40 therein. In the arrangement illustrated, cam track 40 comprises a slot having laterally offset, vertically extending upper and lower portions 42, 44, respectively, connected by an inclined portion 46. A cam follower 47 mounted on the end of a crank arm 48 is engaged by cam track 40.

Figure 8:
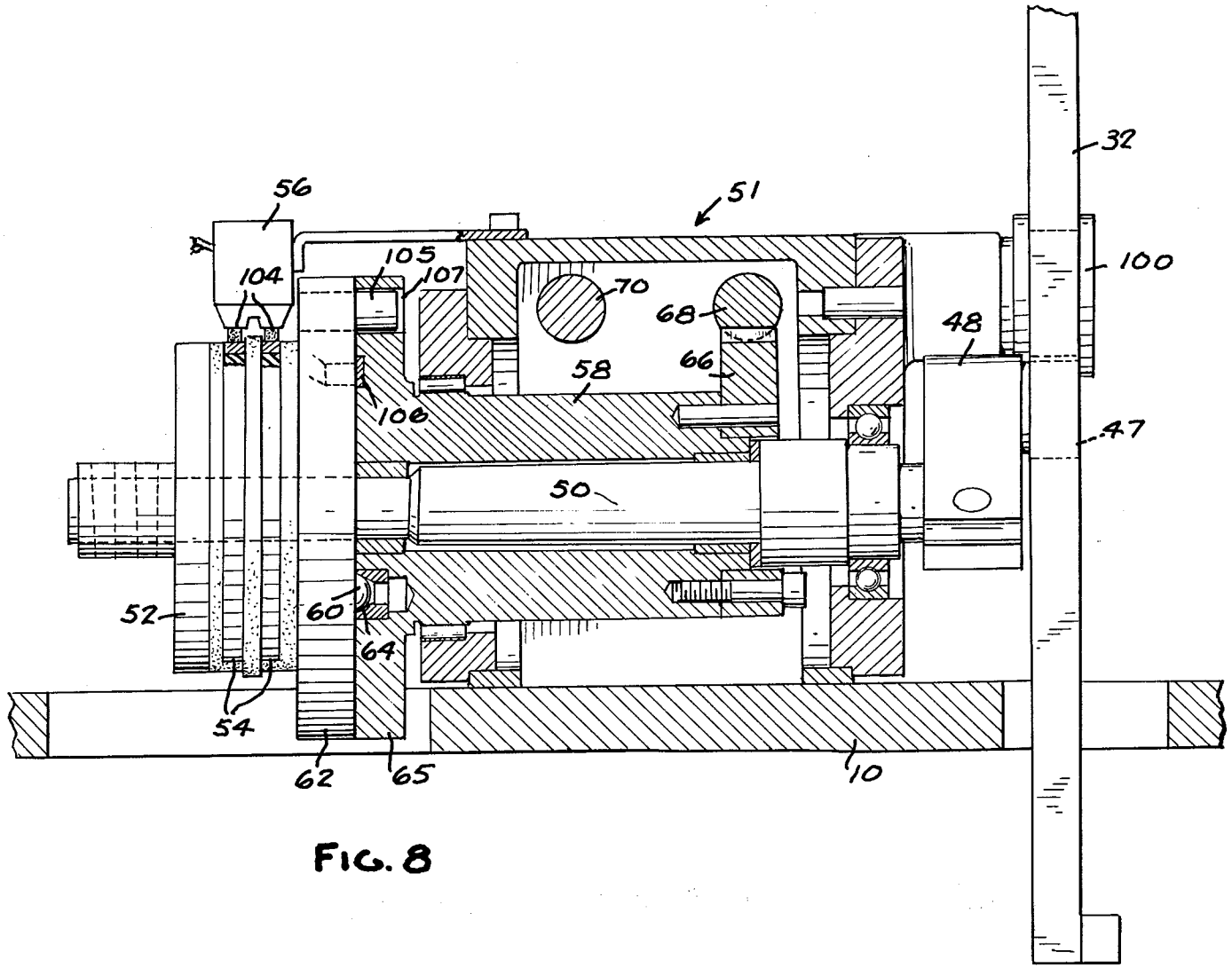
FIG. 8 is a sectional view along the line 8—8 in FIG. 6.

Referring now to FIG. 8 crank arm 48 is fixed on one end of a shaft 50 journalled in a housing 51 on base plate 10. On the opposite end of shaft 50 there is fixed a drum 52 having a pair of electrical contact rings 54 which are normally in series circuit with the motor driving the press through a contact assembly 56. A sleeve 58 is journalled for rotation on shaft 50. Shaft 50 and sleeve 58 are normally coupled by a plurality of spring pressed balls 60 located in an end flange 62 on drum 52. In the coupled condition, balls 60 are seated in conical sockets 64 in the adjacent flanged end 65 of sleeve 58. Sleeve 58 has a gear segment 66 mounted thereon which meshes with a finger bar control rod 68. Control rod 68 is slidably guided in housing 51 and extends toward and transversely of finger bars 26. A second finger bar control rod 70 is also slidably mounted in housing 51 in parallel relationship with control rod 68. Control rods 68, 70 are interconnected by a reversing pinion 72 so that the two control rods reciprocate in opposite directions relative to each other.

Figure 3:
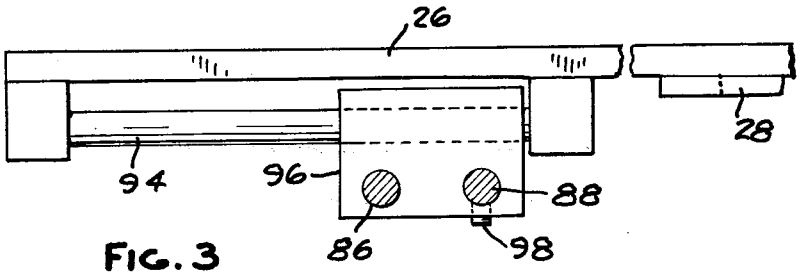
FIG. 3 is a sectional view taken along the line 3—3 in FIG. 1.
Figures 6, 7:
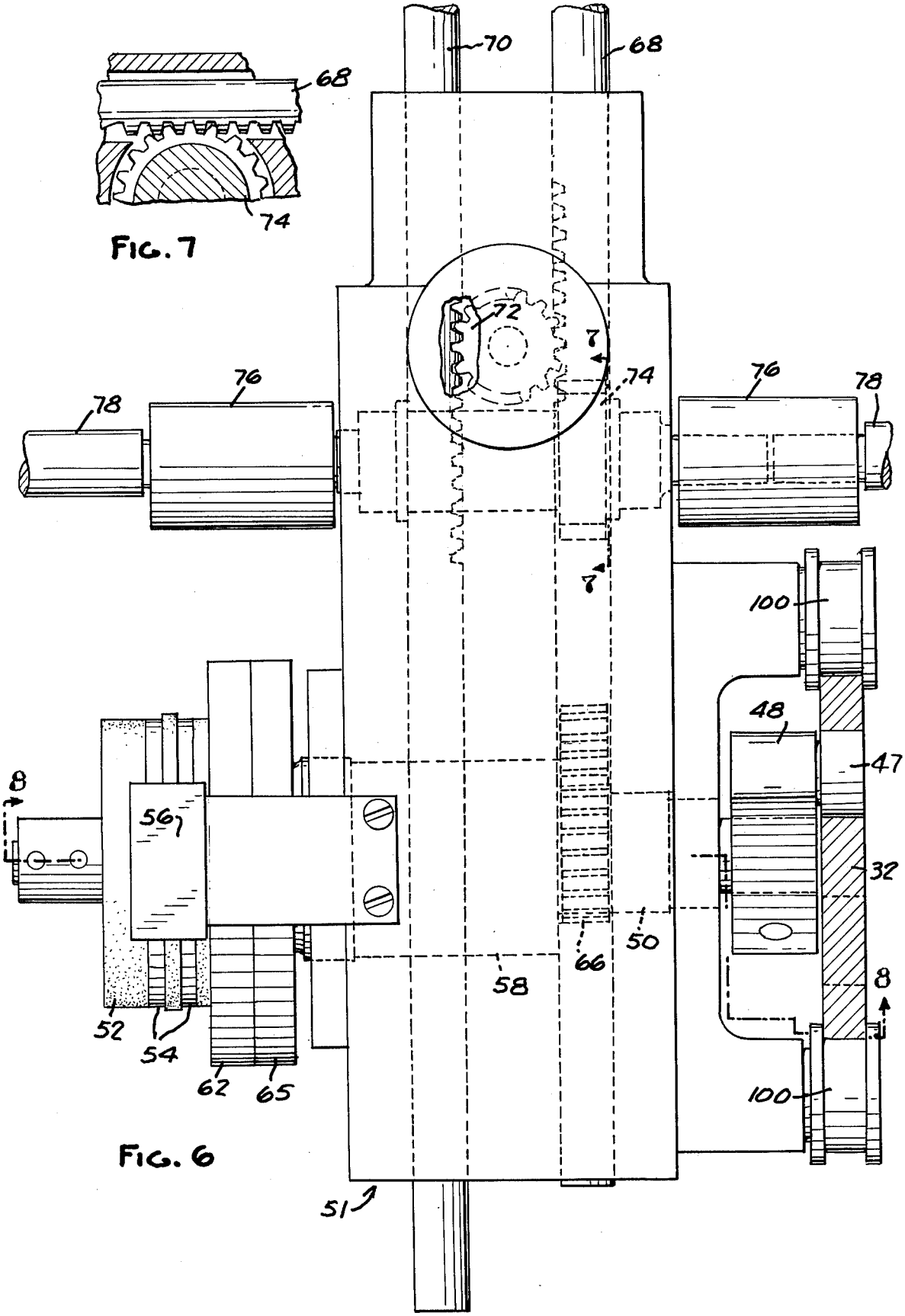
FIG. 6 is a fragmentary view on an enlarged scale of a portion of a mechanism illustrated in FIG. 1.
FIG. 7 is a fragmentary sectional view along the line 7—7 in FIG. 6.

Referring also to FIG. 6 there is journalled in housing 51 a second pinion 74 on an axis parallel to the axis of shaft 50. On each of the opposite sides of housing 51 pinion 74 is keyed to couplings 76 which are in turn connected by shafts 78 to couplings 80 adjacent outboard housings 82 mounted on base plate 10 on opposite sides of housing 51 (FIG. 1). Couplings 80 are connected to the stub shafts of pinions 84 in housings 82 which mesh with rack portions of control rods 86. A second control rod 88 in each housing 82 is connected with control rod 86 by means of a reversing pinion 90. With the control rod arrangement described it will be observed that when control rods 68 and 86 are shifted in a direction toward finger bars 26, control rods 70 and 88 are reciprocated in a direction away from finger bars 26. The distal end of each control rod 86 is slidably guided in a support block 92 fixedly mounted on base plate 10. On the underside of each finger bar 26 there are mounted three pair of parallel guide rods 94 which extend lengthwise of the finger bars. Guide blocks 96 (see FIG. 3) are slidably mounted for movement longitudinally on each pair of rods 94. In order to cause the two finger bars 26 to reciprocate toward and away from each other in unison, one control rod in each pair is fixedly connected to the guide block 96 on one of the finger bars as by a set screw 98, and the other control rod in each pair is rigidly connected to the guide block 96 on the other finger bar. However the control rod 88 of the pair at the right in FIG. 1 is fixedly secured to the guide block 94 closest to the housing 82 and need not extend transversely to the guide block 92 since the adjacent ends of the two finger bars are amply supported and guided on the guide rod 24 on carriage 12.

Figure 2:
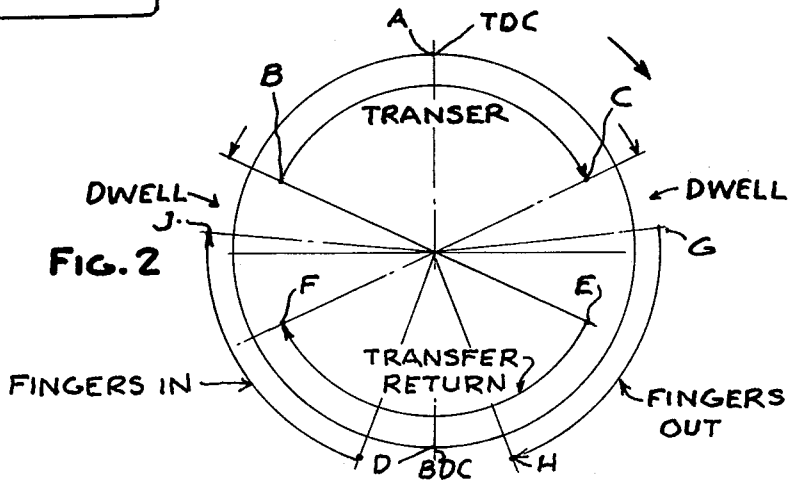
FIG. 2 is a diagram showing the relative timing of the carriage, finger bar and press ram.

With the above described arrangement it will be appreciated that the throw of barrel cam 16 is designed to correspond to the distance between the successive stations in the die and the chain drive 18 is arranged to advance and retract carriage 12 in timed relation with the reciprocation of the press ram. For example as shown in FIG. 2, if the point A represents the crankshaft position of the ram at top dead center the track of cam 16 may be designed to advance carriage 12 as the ram crank is moving from point B to point C. Likewise, if point D represents the bottom dead center position of the ram crank cam 16 can be designed so that the return stroke of the carriage occurs between the points E and F.

As the ram reciprocates vertically, cam plate 32 moves therewith and is guided by a pair of rollers 100 on housing 51. The vertical extent of cam track 40 is greater than the stroke of the press ram so that cam follower 46 remains engaged with track 40 throughout the vertical travel of the ram within the adjustment range of plate 32 on the press ram. Thus when the ram is near its top dead center position, cam follower 47 is disposed in the portion 44 of cam track 40, and when the ram is adjacent its bottom dead center position, cam follower 47 is located in the portion 42 of the cam track 40. Plate 32 is adjusted vertically on ram 34 so that cam follower 47 will encounter the inclined portion 46 of cam track 40 at the desired point of travel of the ram in its upward and downward movement. For example plate 32 can be adjusted on the ram so that on the downstroke thereof when the ram crank reaches point G, cam follower 47 will encounter the lower end of the inclined portion 46 of cam track 40. Through the action of crank 48 and gear segment 66 the two finger bars 26 (which at this point are engaging the workpieces since carriage 12 has just completed its advance stroke) will start to move outwardly away from each other toward their retracted positions. When the press ram crank reaches the point H in FIG. 2, the ram will have descended to a position wherein follower 47 engages the lower end of the upper vertical track portion 42 and both finger bars will have shifted to the completely retracted position. At this point the press ram is approaching bottom dead center and the punches thereon are enabled to perform the necessary stamping operation on the workpieces without interference from the finger bars. When the ram moves upwardly, at point I cam follower 47 engages the upper end of the inclined track portion 46 and starts shifting the finger bars inwardly toward each other until it reaches point J where the workpieces are firmly engaged by the finger bars. After a short dwell, carriage 12 advances to index the gripped workpieces to the next successive stations.

With the above described arrangement it will be appreciated that the slope, length and vertical location of the inclined cam track portion 46 may be varied as desired to produce movement of the finger bars between gripping and retracted positions in a manner most suitable to the size and shape of the workpieces. For example, if the workpieces have a relatively long vertical dimension, cam plate 32 can be shifted vertically downwardly on the press ram so that the finger bars will be retracted sooner on the downstroke of the ram and will be shifted to the work engaging position at a later point on the upstroke of the ram. The vertical extent and the inclination of track portion 46 determines the length of the finger bar stroke and the speed at which the finger bars are shifted in relation to the speed of the ram. It will be appreciated that in the arrangement shown and described the timing and stroke of the finger bars can be varied independently of the stroke of carriage 12. Likewise by utilizing a minimum of gears in the drive train to the finger bars a minimum of backlash is encountered. Thus by proper design of the inclined portion 46 of cam track 40, finger bars 26 can be reciprocated at a rapid rate while at the same time controlled such that the fingers 28 decelerate to zero velocity just as they engage the workpieces. Since backlash and inertial forces are at a minimum, this avoids relatively high impact forces between the finger bars and the workpieces which occurs in many prior transfer mechanisms operating at relatively high speeds.

In the arrangement shown in FIGS. 1 through 8, the work gripping and retracting strokes of the finger bars are both controlled exclusively by cam track 40 since cam follower 47 is trapped. With this type of arrangement it is desirable to provide a means for disconnecting the drive train between cam follower 47 and the finger bar control rods 68, 70, 86, 88 in the event the finger bars encounter an obstruction when they are moving in the work gripping direction. In the present arrangement the automatic release of this driving connection is provided by the clutch formed by the spring pressed balls 60 illustrated in FIG. 8. In the event the finger bars encounter a force of predetermined magnitude when moving in the work gripping direction, the rotation of sleeve 58 is resisted while the driving force on shaft 50 is continued. When the resisting forces reaches a predetermined amount, the balls 60 are displaced from the conical seats 64 against the spring bias on the balls so that the shaft 50 rotates relative to sleeve 58. When this occurs it is highly desirable to de-energize the motor that is operating the press and apply a brake. This is accomplished through contact assembly 54, fixedly mounted on casing 51 and having a pair of contacts 104 engaging contact rings 54. The circuit through contact rings 54 is completed through a small contact plate 106 on the flanged end face of sleeve 58. When flange 62 rotates relative to sleeve 58 the series circuit is broken at contact plate 106, thus stopping the press motor and applying a brake. In any event when the press ram again rises, crank 48 is rotated clockwise as viewed in FIG. 4 and causes arm 52 to rotate in the opposite direction relative to the stationary sleeve 58. When this occurs a pin 105 mounted on drum flange 62 abuts against the end of an arcuate slot 107 in sleeve flange 65 to return the finger bars 26 to the fully retracted position and enables balls 68 to reseat themselves in sockets 64. A more complete showing and description of the operation of this safety overload device is contained in my U.S. Pat. No. 3,738,503, dated June 12, 1973.

Figure 9:
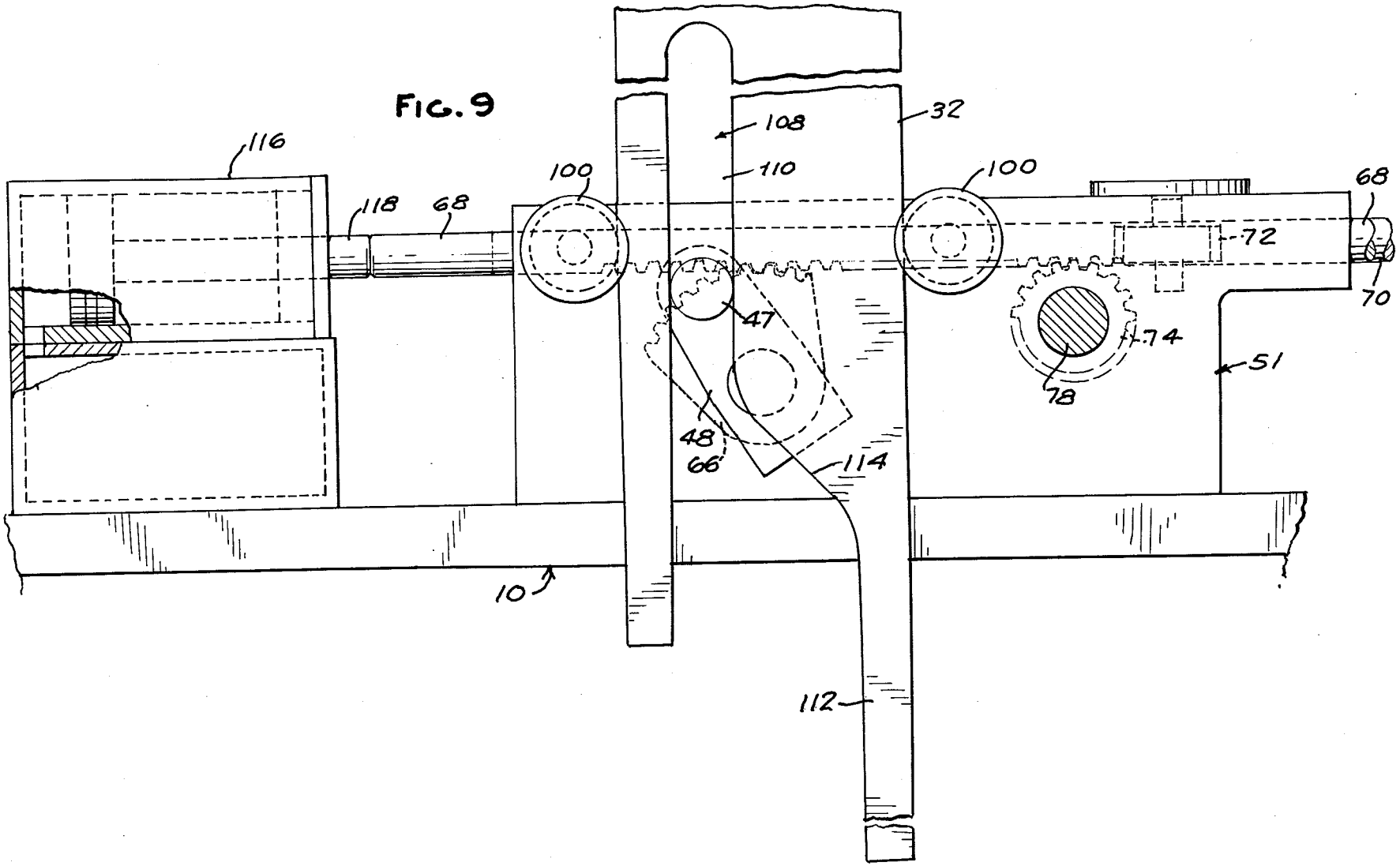
FIG. 9 is a view similar to FIG. 4 showing a modified construction.

The arrangement shown in FIG. 9 differs from the previous embodiment illustrated in that the cam track 108 positively controls the finger bar movement only in the retracting direction. Thus as illustrated in FIG. 9, cam track 108 is only partially formed by a groove 110 at the upper end thereof. At its lower end the cam track is defined by a straight vertically extending edge 112 on cam plate 32 and the inclined portion of the cam track is defined only by the inclined edge 114. With this arrangement an air cylinder 116 is utilized to urge cam follower 47 against the cam track portions 110, 112, 114. Air cylinder 116 includes a piston rod 118 which is urged against the end of finger bar control rod 68 which in turn has its rack portion meshing with gear segment 66. Thus on the downstroke of the press ram, cam track 108 positively displaces crank 48 in a counterclockwise direction to retract the finger bars. However on the upstroke of the ram, cylinder 116 simply urges cam follower 47 toward the straight edge 112 and the inclined edge 114 of the cam track. Thus if the finger bars encounter an obstruction on their inward stroke, the force resisting further inward movement of the finger bars overcomes the bias of air cylinder 116 so that the finger bars are arrested in an out-of-the-way position, either partially or fully retracted, without causing any damage to the die when the punch structure on the ram descends. In other respects the arrangement shown in FIG. 9 is the same as shown in FIGS. 1 through 8.

I claim:

1. In a device for transferring workpieces between successive stations of a die mounted in a stamping press, said transfer device being of the type which comprises a base, a carriage reciprocable on said base in a linear path through a stroke corresponding to the distance between the successive stations in the die and a finger bar mounted for movement with the carriage and for reciprocating movement transversely of the path of travel of the carriage between work engaging and retracted positions, that improvement which comprises means for actuating the finger bar to said work engaging and retracted positions comprising a cam adapted to be mounted on and reciprocate in a linear path with the ram of the press, said cam having a track thereon extending generally in the direction of said linear path of reciprocation of said ram and having a portion offset transversely of said last-mentioned linear path, a crank rotatably mounted on said base, a cam follower on said crank and adapted to be interengaged by said cam track and to be displaced by said offset portion thereof in response to said reciprocation of the ram to rotate said crank in opposite directions and means operably interconnecting said crank and said finger bar for shifting the finger bar between said work engaging and retracted positions in response to rotation of said crank.

2. The transfer device called for in claim 1 wherein said cam is provided with means thereon for adjusting its position relative to the ram in a direction parallel to the path of travel of the ram whereby to permit adjustment in the timing of the actuation of the finger bar in relation to the movement of the ram.

3. The transfer device called for in claim 2 wherein said cam comprises a plate and said adjustment means comprises a slot extending parallel to said end portions of the cam track and by means of which the plate is adapted to be mounted on the ram.

4. The transfer device called for in claim 1 wherein said last-mentioned means comprise a control rod slidably mounted on said base for movement in a path transversely of the path of travel of the carriage, said finger bar being connected with said control rod, said control rod having a portion thereof formed as a gear rack and a gear on said crank meshing with said gear rack.

5. The transfer device called for in claim 4 including a support mounted on said finger bar for movement relative thereto in a direction parallel to the path of travel of the carriage, said control rod being connected with said last-mentioned support.

6. The transfer device called for in claim 1 wherein said last-mentioned means comprises a gear connected to said crank at the rotating axis thereof and a gear rack interconnecting said gear and finger bar.

7. The transfer device called for in claim 6 including an overload clutch interposed between said crank and said gear for rendering the connection between said gear and crank inoperative to actuate the finger bar toward the work engaging position in response to a force of predetermined magnitude opposing movement of the finger bar in the work engaging direction.

8. The transfer device called for in claim 6 wherein said gear rack is reciprocated by said gear in a direction perpendicular to the path of travel of the carriage.

9. The transfer device called for in claim 8 wherein said gear rack is fixed on said base in a direction parallel to the path of travel of the carriage and means interconnecting said gear rack and finger bar for causing the finger bar to move with the gear rack in a direction transversely to the path of travel of the carriage and relative to the gear rack in a direction parallel to the path of travel of the carriage.

10. The transfer device called for in claim 8 including a shaft extending parallel to the path of travel of the carriage, said shaft being operatively connected with said gear for rotation thereby, a second gear on said shaft at a location remote from said first-mentioned gear, a second gear rack operatively connected with the second gear for reciprocation along a path parallel to the path of reciprocation of the first gear rack, said second gear rack being operatively connected with said finger bar at a location spaced lengthwise of the finger bar from the connection of the first gear rack with the finger bar.

11. The transfer device called for in claim 1 wherein said offset portion of said cam track comprises a contoured edge, said cam follower being movable toward and away from said contoured edge in a direction transversely of the linear path of travel of the cam, means yieldably biasing the cam follower toward said contoured edge, said contoured edge being disposed to positively displace the finger bar in the retracting direction against the bias of said yielding means, whereby, when the force resisting movement of said finger bar in the work engaging direction exceeds the force of said biasing means, the cam follower moves out of engagement with said contoured edge.

12. In a device for transferring workpieces between successive stations of a die mounted in a stamping press, said transfer device being of the type which comprises a base, a carriage reciprocable on said base in a linear path through a stroke corresponding to the distance between the successive stations in the die and a finger bar mounted for movement with the carriage and for reciprocating movement transversely of the path of travel of the carriage between work engaging and retracted positions, that improvement which comprises means for actuating the finger bar to said work engaging and retracted positions comprising a cam adapted to be mounted on and reciprocate in a linear path with the ram of the press, said cam having a contoured edge defining a cam track extending generally in the direction of said linear path of reciprocation of said ram and having a portion offset transversely of said last-mentioned linear path, a cam follower movably mounted on said support and adapted to be interengaged by said cam track and to be displaced by said offset portion thereof in response to reciprocation of the ram, a fluid cylinder yieldably biasing said cam follower into engagement with said contoured edge and means operably interconnecting said cam follower and said finger bar for shifting the finger bar between said work engaging and retracted positions in response to displacement of the cam follower by said offset portion of the cam track.

13. The transfer device called for in claim 12 wherein said fluid cylinder is arranged to bias said finger bar in the work engaging direction and said offset portion of said contoured edge is disposed to displace the finger bar in the retracting direction against the bias of said cylinder.

* * * * *